US011006715B2

(12) United States Patent
Yang

(10) Patent No.: US 11,006,715 B2
(45) Date of Patent: May 18, 2021

(54) POWER BANK STORAGE DEVICE AND LUGGAGE CASE COMPRISING SAME

(71) Applicant: ELITE FASHION INTERNATIONAL LTD, Zhejiang (CN)

(72) Inventor: Roger Yang, Pomona, CA (US)

( * ) Notice: Subject to any disclaimer, the term of this patent is extended or adjusted under 35 U.S.C. 154(b) by 329 days.

(21) Appl. No.: 16/174,316

(22) Filed: Oct. 30, 2018

(65) Prior Publication Data

US 2020/0069013 A1 Mar. 5, 2020

(51) Int. Cl.
*A45C 5/06* (2006.01)
*A45C 5/03* (2006.01)
*A45C 15/00* (2006.01)

(52) U.S. Cl.
CPC ..... *A45C 5/06* (2013.01); *A45C 5/03* (2013.01); *A45C 15/00* (2013.01)

(58) Field of Classification Search
CPC ..... A45C 5/06; A45C 5/03; A45C 15/00
See application file for complete search history.

(56) References Cited

U.S. PATENT DOCUMENTS 790,483 A * 5/1905 DeMartini ..... E05C 17/085 217/60 C
1,862,868 A * 6/1932 Sukoff ..... E05C 17/16 229/125
1,912,297 A * 5/1933 Myers ..... E05C 17/04 217/58
2,489,553 A * 11/1949 Henderson ..... A47B 23/043 190/1
2,842,278 A * 7/1958 Murphy ..... E05C 17/16 217/60 D
4,356,918 A * 11/1982 Kahle ..... G11B 33/0433 206/308.3
4,428,482 A * 1/1984 Ogawa ..... G11B 23/0233 206/387.1
4,676,375 A * 6/1987 Willems ..... G11B 33/04 206/308.3
5,415,255 A * 5/1995 Hafner ..... A45C 7/005 190/107
10,376,031 B1 * 8/2019 Majhess ..... A45C 5/03
10,868,434 B2 * 12/2020 Goldner ..... A45C 15/00
2012/0152677 A1 * 6/2012 Lu ..... A45C 5/14 190/18 A
2019/0069659 A1 * 3/2019 Van Loon ..... A45C 9/00

* cited by examiner

*Primary Examiner* — Tri M Mai

(57) ABSTRACT

Disclosed is a power bank storage device. The device includes a fixed plate, a push-and-pull plate, a limiting plate and snap-fitting components. The push-and-pull plate corresponds to the fixed plate in position and is rotatably connected at one end; a side surface of the push-and-pull plate close to the fixed plate is integrally connected with a box body with an opening upper end for storing a power bank; the limiting plate is mounted between the fixed plate and the push-and-pull plate, and between the open position and the closed position of the push-and-pull plate, one end thereof is slidably connected with the fixed plate, and the other end thereof is rotatably connected with the push-and-pull plate; and the snap-fitting components are fixed onto the fixed plate, and are snap-fitted with the limiting plate in the closed position of the push-and-pull plate.

10 Claims, 8 Drawing Sheets

POWER BANK STORAGE DEVICE AND LUGGAGE CASE COMPRISING SAME

CROSS-REFERENCE TO RELATED APPLICATIONS

This application claims to Chinese Application No. 201810998779.9 with a filing date of Aug. 30, 2018. The content of the aforementioned application, including any intervening amendments thereto, is incorporated herein by reference.

TECHNICAL FIELD

The present invention relates to the technical field of luggage cases, and more particularly to a power bank storage device and a luggage case comprising same.

BACKGROUND

With the growth of the people's living standard and the increase of business activities, a luggage case has already become an essential article for people during the trip. Meanwhile, because electronic products such as smart cellphones, tablet computers, etc. are also widely used in daily life, these electronic products must be charged at any time during the trip, to guarantee the normal use thereof. Therefore, a power bank has also become an essential travel accessory during the trip.

Because the power bank must be checked when a person goes through the security check, and no device for separately storing the power bank is arranged in the traditional luggage case, the person must open the luggage case and take out the power bank when going through the security check, thereby consuming time and labor, increasing the waiting time for people to go through the security check, and reducing the security check efficiency.

Therefore, the problem to be urgently solved by those skilled in the art is how to provide a power bank storage device capable of being quickly opened or closed and a luggage case comprising same.

SUMMARY

In view of this, the present invention provides a power bank storage device and a luggage case comprising same. The power bank storage device may be mounted on the luggage case or other device, thereby not only facilitating storing the power bank, but also facilitating taking same out or placing same in, and being simple and convenient in operation.

To achieve the above purpose, the present invention adopts the following technical solution:

A power bank storage device, comprising:

a fixed plate, a push-and-pull plate, a limiting plate and snap-fitting components, wherein the push-and-pull plate corresponds to the fixed plate in position and is rotatably connected at one end; and a side surface of the push-and-pull plate close to the fixed plate is integrally connected with a box body with an opening upper end for storing a power bank;

the limiting plate is mounted between the fixed plate and the push-and-pull plate, and between the open position and the closed position of the push-and-pull plate, one end thereof is slidably connected with the fixed plate, and the other end thereof is rotatably connected with the push-and-pull plate; and the snap-fitting components are fixed onto the fixed plate, and are snap-fitted with the limiting plate in the closed position of the push-and-pull plate.

It can be known from the above technical solution that, compared with the prior art, first, the present invention has the advantage that it is guaranteed that a space for separately storing the power bank may be reserved on other device by fixing the fixed plate onto other device, thereby facilitating carrying the power bank and facilitating taking out the power bank;

second, the present invention has the advantage that the stroke of the push-and-pull plate is limited by arranging the limiting plate between the fixed plate and the push-and-pull plate, so that the moving scope of the push-and-pull plate is appropriate, thereby avoiding falling of the power bank due to overlarge opening angle of the push-and-pull plate relative to the fixed plate because of overexerting; and finally, the present invention has the advantage that when the device is closed, the fixed plate is snap-fitted with the push-and-pull plate by the snap-fitting components by slight pressing, and when the device is opened, the push-and-pull plate is separated from the snap-fitting components by forceful pulling, thus the device is conveniently and quickly operated, and is firmly fixed.

Preferably, in the power bank storage device, the box body is in a rectangular shape, and one ends of two side walls parallel with each other of the box body connected with the bottom wall of the box body outwards extend to the end of the push-and-pull plate to form first connecting sheets, the first connecting sheets being provided with first axial holes or first axial grooves; and one end of the fixed plate is integrally connected with a rotating shaft, both ends of the rotating shaft respectively extending in the two corresponding first axial holes or first axial grooves to be rotatably connected with same.

Preferably, in the power bank storage device, the fixed plate is provided with a groove, the groove being adapted to the limiting plate in shape.

Preferably, in the power bank storage device, two side walls parallel with each other of the groove are provided with chutes; and two second connecting sheets arranged in parallel are fixed onto the outer end surface of one side wall of the box body away from the push-and-pull plate, the second connecting sheets being arranged close to the opening end of the box body, and the second connecting sheets being provided with second axial holes or second axial grooves;

a first connecting shaft and a second connecting shaft are mounted at the outer contour edge of the limiting plate, the first connecting shaft is arranged in parallel with the second connecting shaft, and both ends thereof extend out the edge of the limiting plate; both ends of the first connecting shaft respectively extend in the chutes and are slidably connected with the chutes, and both ends of the second connecting shaft respectively extend in the second axial holes or the second axial grooves and are rotatably connected with the second axial holes or the second axial grooves.

Preferably, in the power bank storage device, the mounting positions of the snap-fitting components correspond to the position of the second connecting shaft, and the snap-fitting components are snap-fitted with the peripheral side of the second connecting shaft.

Preferably, in the power bank storage device, the end of the push-and-pull plate close to the opening end of the box body extends in a bending mode in the direction away from the fixed plate.

Preferably, in the power bank storage device, the snap-fitting components are fixedly connected with the fixed plate by bolts.

The present invention also provides a luggage case, the power bank storage device being mounted on the outer surface of the luggage case.

Preferably, the luggage case comprises a case body and a pull rod, wherein case body is provided with an accommodating groove at the side close to the pull rod, and the power bank storage device is mounted in the accommodating groove and is matched with the accommodating groove in size.

Preferably, the luggage case further comprises back plates, wherein the back plates are located on an inner side wall of the case body and correspond to the bottom of the accommodating groove in position, the fixed plate comes into contact with the bottom of the accommodating groove, and the back plates, the side wall of the case body and the fixed plate are fixedly connected in sequence by bolts.

It can be known from the above technical solution that, compared with the prior art, the present invention has the advantage that the power bank may be quickly taken out or put in when a person goes through the security check by mounting the power bank storage device on the surface of the luggage case, thereby greatly reducing the time wasted because of opening the case to seek for the power bank, reducing the waiting time of queuing people, and being convenient and quick in operation, and that charging electronic products during the trip in real time may be guaranteed.

DESCRIPTION OF DRAWINGS

To more clearly describe the technical solution in the embodiments of the present invention or in the prior art, the drawings required to be used in the description of the embodiments or the prior art will be simply presented below. Apparently, the drawings in the following description are merely the embodiments of the present invention, and for those ordinary skilled in the art, other drawings can also be obtained according to the provided drawings without contributing creative labor.

IN THE DRAWINGS

Figure 1:
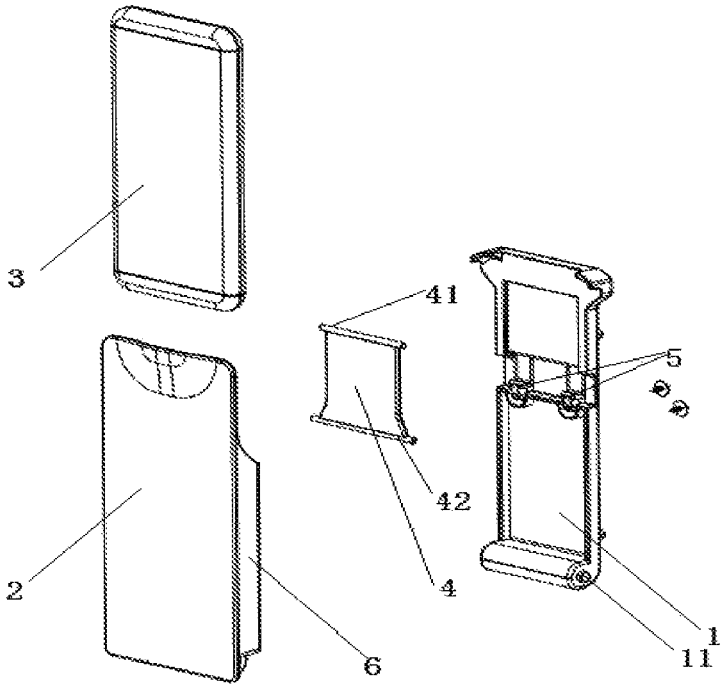
FIG. 1 is an explosion diagram of a power bank storage device of the present invention.
Figure 2:
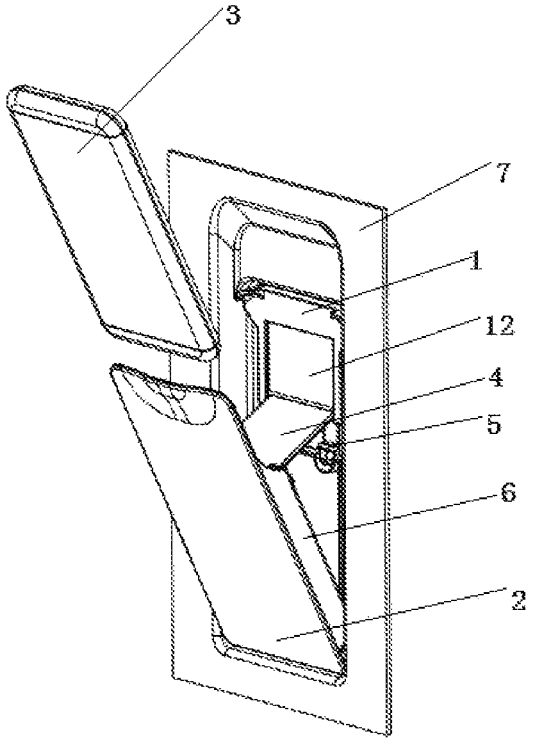
FIG. 2 is a structural schematic diagram of an opened power bank storage device mounted on other device of the present invention.
Figure 3:
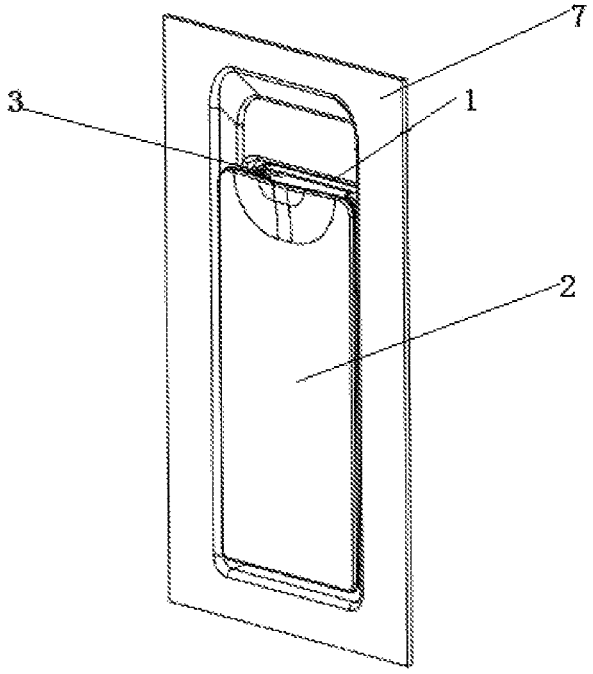
FIG. 3 is a structural schematic diagram of a closed power bank storage device mounted on other device of the present invention.
Figure 4:
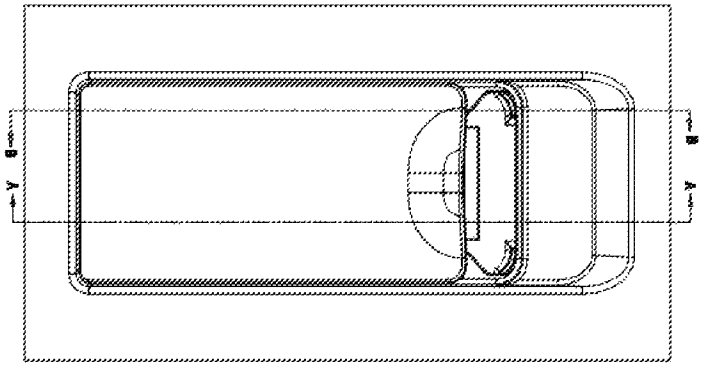
FIG. 4 is a main view of a power bank storage device mounted on other device of the present invention.
Figure 5:
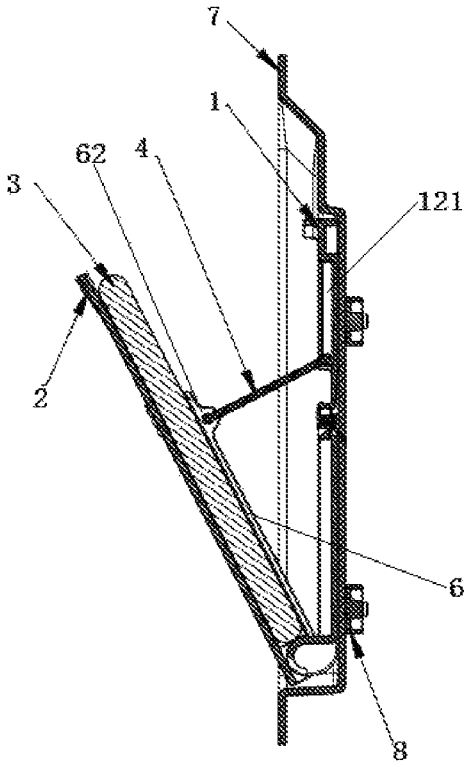
FIG. 5 is an A-A section view of FIG. 4.
Figure 6:
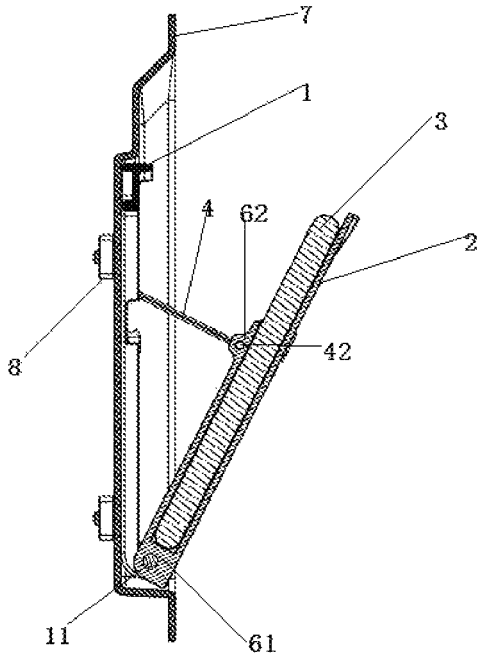
FIG. 6 is a B-B section view of FIG. 4.

1. fixed plate; 11. rotating shaft; 12. groove; 121. chute; 2. push-and-pull plate; 3. power bank; 4. limiting plate; 41. first connecting shaft; 42. second connecting shaft; 5. snap-fitting component; 6. box body; 61. first connecting sheet; 62. second connecting sheet; 7. case body; 71. accommodating groove; 8. back plate.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

As shown in FIGS. 1-6, embodiments of the present invention disclose a power bank storage device, comprising: a fixed plate 1, a push-and-pull plate 2, a limiting plate 4 and snap-fitting components 5.

The fixed plate 1 is used for fixedly connecting with other device.

The push-and-pull plate 2 corresponds to the fixed plate 1 in position and is rotatably connected at one end; and a side surface of the push-and-pull plate 2 close to the fixed plate 1 is integrally connected with a box body 6 with an opening upper end for storing a power bank 3.

The box body 6 is in a rectangular shape, and one ends of two side walls parallel with each other of the box body 6 connected with the bottom wall of the box body 6 outwards extend to the end of the push-and-pull plate 2 to form first connecting sheets 61, the first connecting sheets 61 being provided with first axial holes or first axial grooves; and one end of the fixed plate is integrally connected with a rotating shaft, both ends of the rotating shaft respectively extending in the two corresponding first axial holes or first axial grooves to be rotatably connected with same.

The limiting plate 4 is mounted between the fixed plate 1 and the push-and-pull plate 2, and between the open position and the closed position of the push-and-pull plate 2, one end thereof is slidably connected with the fixed plate 1, and the other end thereof is rotatably connected with the push-and-pull plate 2; and the fixed plate 1 is provided with a groove 12, the groove 12 being adapted to the limiting plate 4 in shape. Two side walls parallel with each other of the groove 12 are provided with chutes 121; and two second connecting sheets 62 arranged in parallel are fixed onto the outer end surface of one side wall of the box body 6 away from the push-and-pull plate 2, the second connecting sheets 62 being arranged close to the opening end of the box body 6, and second connecting sheets 62 being provided with second axial holes or second axial grooves; and a first connecting shaft 41 and a second connecting shaft 42 are mounted at the outer contour edge of the limiting plate 4, the first connecting shaft 41 is arranged in parallel with the second connecting shaft 42, and both ends of the first connecting shafts 41 and the second connecting shafts 42 extend out the edge of the limiting plate 4; both ends of the first connecting shaft 41 respectively extend in the chutes 121 and are slidably connected with the chutes 121, and both ends of the second connecting shaft 42 respectively extend in the second axial holes or the second axial grooves and are rotatably connected with the second axial holes or the second axial grooves.

Two snap-fitting components 5 are arranged and are connected with the fixed plate 1 by bolts, the mounting positions of the snap-fitting components 5 correspond to the position of the second connecting shaft 42, and the snap-fitting components are snap-fitted with the peripheral side of the second connecting shaft 42.

More advantageously, the end of the push-and-pull plate 2 close to the opening end of the box body 6 extends in a bending mode in the direction away from the fixed plate 1. The design of outward bending of the push-and-pull plate 2 may guarantee that a large space is reserved between the push-and-pull plate 2 and the fixed plate 1, thereby facilitating people's fingers in extending in the space to push and pull the push-and-pull plate 2.

More advantageously, the rotating shaft 11 comprises a large diameter portion and a small diameter portion, wherein the large diameter portion is integrally connected to one end of the fixed plate 1 and is flush with two side edges of the fixed plate 1, the small diameter portion is integrally connected to two end surfaces of the large diameter portion respectively and is coaxially arranged with the large diameter portion, the large diameter portion is located between the two first connecting sheets 61 parallel with each other, and the small diameter portion extends in the first axial holes or the first axial grooves in the two first connecting sheets 61 respectively to rotate.

Figure 7:
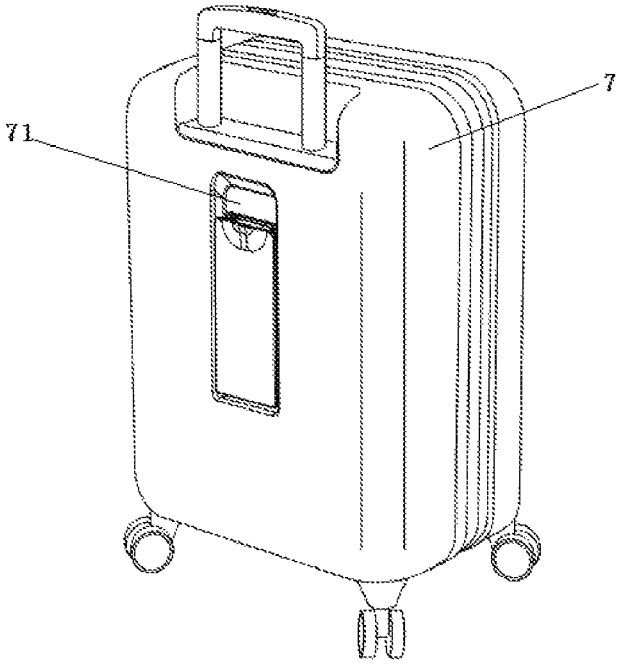
FIG. 7 is a structural schematic diagram of a luggage case of the present invention.
Figure 8:
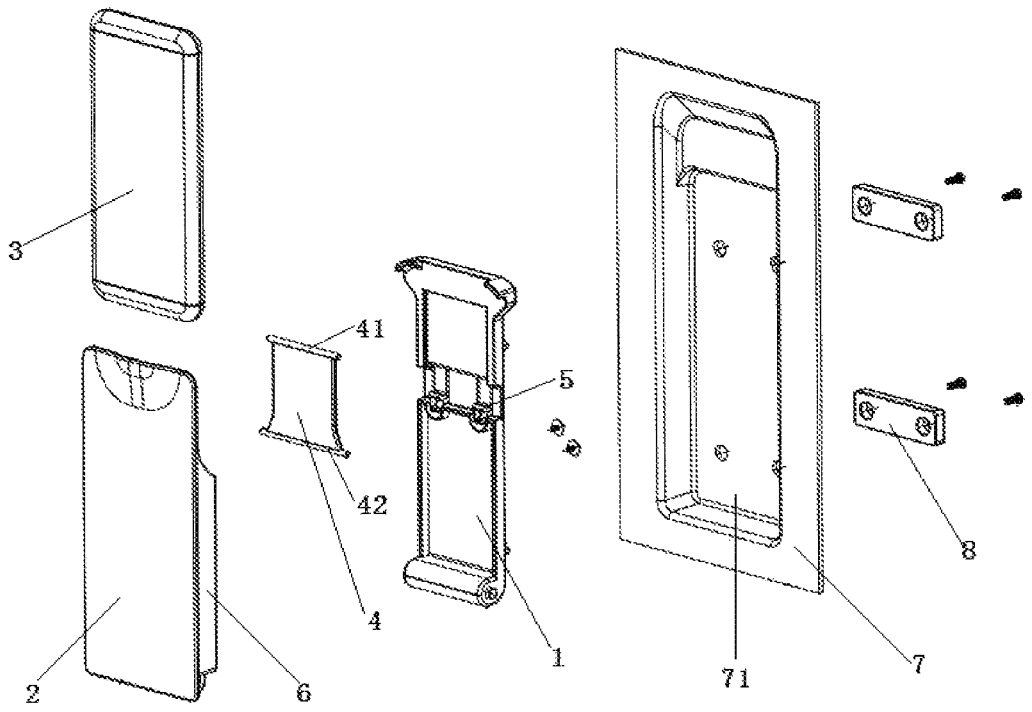
FIG. 8 is an explosion diagram of a luggage case of the present invention.

As shown in FIGS. 7-8, embodiments of the present invention disclose a luggage case, the power bank storage device being mounted on the outer surface of the luggage case.

The luggage case comprises a case body 7 and a pull rod, wherein case body 7 is provided with an accommodating groove 71 at the side close to the pull rod, and the power bank storage device is mounted in the accommodating groove 71 and is matched with the accommodating groove 71 in size. The push-and-pull plate 2 is located on the same plane as the outer surface of the case body 1 when closing or the push-and-pull plate 2 is completely arranged in the accommodating groove 71.

More advantageously, the luggage case further comprises back plates 8, wherein the back plates 8 are located on an inner side wall of the case body 7 and correspond to the bottom of the accommodating groove 71 in position, the fixed plate 1 comes into contact with the bottom of the accommodating groove 71, and the back plates 8, the side wall of the case body 7 and the fixed plate 1 are fixedly connected in sequence by bolts.

Two back plates 8 are arranged, and are respectively arranged close to both ends of the fixed plate 1.

Each embodiment in the description is described in a progressive way. The difference of each embodiment from each other is the focus of explanation. The same and similar parts among all of the embodiments can be referred to each other. For a device disclosed by the embodiments, because the device corresponds to a method disclosed by the embodiments, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. A power bank storage device, comprising: a fixed plate (1), a push-and-pull plate (2), a limiting plate (4) and snap-fitting components; wherein the push-and-pull plate (2) corresponds to the fixed plate (1) in position and is rotatably connected at one end; and a side surface of the push-and-pull plate (2) close to the fixed plate (1) is integrally connected with a box body (6) with an opening upper end for storing a power bank (3); the limiting plate (4) is mounted between the fixed plate (1) and the push-and-pull plate (2), and between the open position and the closed position of the push-and-pull plate (2), one end thereof is slidably connected with the fixed plate (1), and the other end thereof is rotatably connected with the push-and-pull plate (2); and the snap-fitting components (5) are fixed onto the fixed plate (1), and are snap-fitted with the limiting plate (4) in the closed position of the push-and-pull plate (2).

2. The power bank storage device according to claim 1, wherein the box body (6) is in a rectangular shape, and one ends of two side walls parallel with each other of the box body (6) connected with the bottom wall of the box body (6) outwards extend to the end of the push-and-pull plate (2) to form first connecting sheets (61), the first connecting sheets (61) being provided with first axial holes or first axial grooves; and one end of the fixed plate (1) is integrally connected with a rotating shaft (11), both ends of the rotating shaft (11) respectively extending in the two corresponding first axial holes or first axial grooves to be rotatably connected with same.

3. The power bank storage device according to claim 1, wherein the fixed plate (1) is provided with a groove (12), the groove (12) being adapted to the limiting plate (4) in shape.

4. The power bank storage device according to claim 3, wherein two side walls parallel with each other of the groove (12) are provided with chutes (121); and two second connecting sheets (62) arranged in parallel are fixed onto the outer end surface of one side wall of the box body (6) away from the push-and-pull plate (2), the second connecting sheets (62) being arranged close to the opening end of the box body (6), and the second connecting sheets (62) being provided with second axial holes or second axial grooves; and a first connecting shaft (41) and a second connecting shaft (42) are mounted at the outer contour edge of the limiting plate (4), the first connecting shaft (41) is arranged in parallel with the second connecting shaft (42), and both ends thereof extend out the edge of the limiting plate (4); both ends of the first connecting shaft (41) respectively extend in the chutes (121) and are slidably connected with the chutes (121), and both ends of the second connecting shaft (42) respectively extend in the second axial holes or the second axial grooves and are rotatably connected with the second axial holes or the second axial grooves.

5. The power bank storage device according to claim 4, wherein the mounting positions of the snap-fitting components (5) correspond to the position of the second connecting shaft (42), and the snap-fitting components are snap-fitted with the peripheral side of the second connecting shaft (42).

6. The power bank storage device according to claim 1, wherein the end of the push-and-pull plate (2) close to the opening end of the box body (6) extends in a bending mode in the direction away from the fixed plate (1).

7. The power bank storage device according to any one of claim 1, wherein the snap-fitting components (5) are fixedly connected with the fixed plate (1) by bolts.

8. A luggage case, wherein the power bank storage device of claim 1 is mounted on the outer surface of the luggage case.

9. The luggage case according to 8, wherein the luggage case comprises a case body (7) and a pull rod, wherein the case body (7) is provided with an accommodating groove (71) at the side close to the pull rod, and the power bank storage device is mounted in the accommodating groove (71) and is matched with the accommodating groove (71) in size.

10. The luggage case according to 8, further comprising: back plates (8), wherein the back plates (8) are located on an inner side wall of the case body (7) and correspond to the bottom of the accommodating groove (71) in position, the fixed plate (1) comes into contact with the bottom of the accommodating groove (71), and the back plates (8), the side wall of the case body (7) and the fixed plate (1) are fixedly connected in sequence by bolts.

* * * * *